US007841598B1

(12) United States Patent
Berg

(10) Patent No.: US 7,841,598 B1
(45) Date of Patent: Nov. 30, 2010

(54) DYNAMIC GAME

(76) Inventor: Donald Berg, 16530 Cherry Hill Ave., Tinley Park, IL (US) 60487

( * ) Notice: Subject to any disclaimer, the term of this patent is extended or adjusted under 35 U.S.C. 154(b) by 0 days.

(21) Appl. No.: 12/585,710

(22) Filed: Sep. 23, 2009

(51) Int. Cl.
*A63B 67/06* (2006.01)

(52) U.S. Cl. ..... 273/400; 273/317; 273/348; 273/393; 273/402; 273/398

(58) Field of Classification Search ..... 273/317, 273/336, 348, 407, 393, 386, 398, 400–402, 273/440, 459
See application file for complete search history.

(56) References Cited

U.S. PATENT DOCUMENTS 1,636,966 A * 7/1927 Martin ..... 273/407
3,862,758 A * 1/1975 McLamb ..... 273/393
4,461,484 A * 7/1984 Headrick ..... 273/400
4,936,575 A * 6/1990 Ortiz ..... 273/440
5,522,598 A * 6/1996 Loyd et al. ..... 273/402
6,948,713 B1 * 9/2005 Grunfeld ..... 273/400
7,101,293 B2 * 9/2006 Tarng et al. ..... 473/446
2001/0033057 A1 * 10/2001 Chittenden ..... 273/400
2003/0025272 A1 * 2/2003 Billig et al. ..... 273/400
2006/0103072 A1 * 5/2006 Mercieca ..... 273/348

* cited by examiner

*Primary Examiner*—Raleigh W. Chiu
(74) *Attorney, Agent, or Firm*—Evan D. Roberts

(57) ABSTRACT

This is a game including a basket supporting an untethered support element which, in turn, supports a free standing scoring body element.

6 Claims, 1 Drawing Sheet

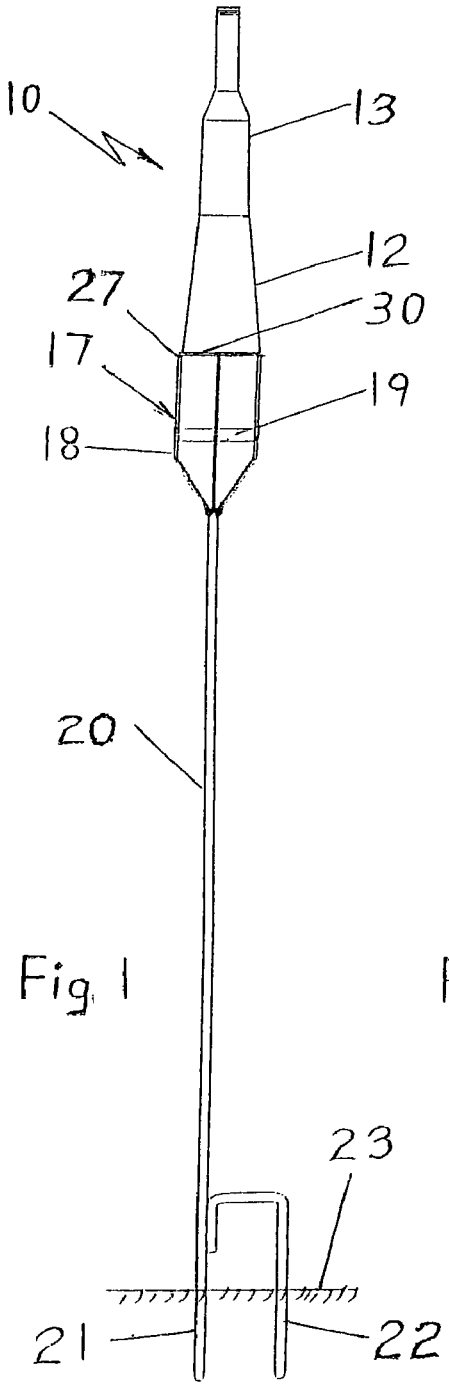
Fig. 1
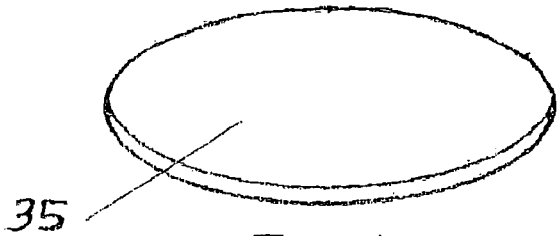
Fig. 4
Fig. 3
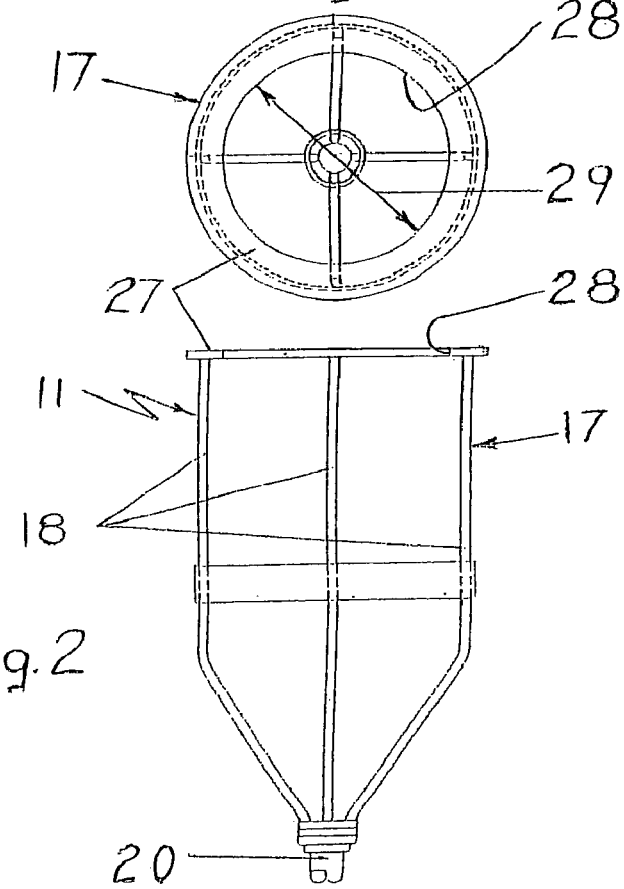
Fig. 2

DYNAMIC GAME

BACKGROUND OF THE INVENTION

Games, known to the inventor, include stacked or otherwise arranged elements which can be subjected to action by a game player to disrupt the arrangement of the game elements in a certain prescribed fashion to count as score in the game.

However, none of the games known to the inventor provide for a special arrangement of stacked elements to be disrupted by the game player so that, by chance, one of the stacked elements can fall into one other of the stacked elements of the game for a game score.

SUMMARY OF THE INVENTION

This invention relates to a game having elements stacked over a specifically designed basket whereby, if one element of the stack is removed, an element above the removed element can, by chance, drop into the basket as a score of the game.

None of the games known to the inventor provide for a game with elements of a particular shape and design to provide a special arrangement of stacked elements to be disrupted by the game player so that and where, by chance, one of the stacked elements can fall into one other of the stacked elements of the game.

Other advantages and other novel aspects of the invention will become apparent upon consideration of the following detailed description thereof in conjunction with the accompanying drawings wherein:

FIG. 1 is a general view of the game showing the interrelationship of the stacked elements thereof.

FIG. 2 is a side view of the basket, of the invention, for supporting the elements of the invention and registering a score in the game.

FIG. 3 is a top view of the basket of the game illustrating a platform on the top thereof for supporting stacked elements of the game.

FIG. 4 is an isometric view of a disc used in the game when directed at the elements of the game.

The invention is generally represented by the numeral 10 (FIG. 1) and generally includes a basket assembly 11, untethered support element 12 and a free standing scoring element 13.

Basket assembly 11 (FIGS. 1-3) includes a basket 17 having bars 18 arranged to form basket 17 with reinforcing band 19 and is secured to a basket support pole at 20. Pole 20, as shown, has a lower end 21 and can have an attached leg 22 for supporting pole 20 in ground 23.

Basket 17 (FIGS. 2 & 3) has top enclosure platform 27 with an aperture 28 therethrough providing an aperture with an inside diameter 29 of a certain size greater than an outer diameter 30 of untethered support body element 12. Untethered support body element 12 (FIG. 1) preferably has a certain mass and, as shown, is freely supported on basket platform 27 above aperture 28 of basket 17. A disc 35 (FIG. 4) can be thrown at scoring element 13 to dislodge element 13 from beneath scoring element to apply a dynamic impact on scoring element 13 to remove scoring element 13 from the stack of elements 12 and 13 (FIG. 1).

Scoring body 13 (FIG. 1) preferably has a certain mass greater than the mass of untethered body 12 and is normally stably supportable on untethered body 12 in a vertically stacked relationship (FIG. 1). In preferred illustration of the stacked relationship of the elements 12 and 13, free standing scoring element 13 is a simulated bottle made of wood and has a certain mass, as the scoring body 13. Untethered support 12 is a lighter plastic cup of lesser mass supporting the scoring body 13 over aperture 20 of basket 17.

In the play of the game hereof (FIG. 1) elements 12 and 13 are stacked on platform 27 of basket 17. Dynamic lateral movement of untethered support body 12 will tend to move body 12 out of stacked support of scoring body 13 to allow scoring body 13 to tend to move, by gravity, downwardly, and by chance, through basket aperture 28 and into basket 17 for a game score.

It is to be understood that the invention is not to be limited to the specific construction and arrangements shown and described, as it will be understood to those skilled in the art that certain changes may be made without departing from the principles of the invention.

What is claimed:

1. A game comprising a basket having a top enclosure, with an aperture therethrough of a certain size, an untethered support adapted to rest on said basket top vertically over aperture of said basket top, a free standing scoring body having a lateral dimension of a certain size smaller than said basket top aperture whereby said free standing body can pass through said basket top aperture into said basket, and said untethered support adapted to removably support said free standing scoring body in stacked relation on top of said untethered support above said basket and vertically between said basket and said free standing scoring body whereby when a game player removes said untethered support said free standing scoring body can drop toward said basket and by chance pass downwardly through said basket top aperture into said basket as a score of said game.

2. A game as described in claim 1 wherein said basket top enclosure comprises a horizontal support platform defining said aperture and adapted to support said untethered support.

3. A game as described in claim 1 wherein said free standing scoring body has a certain mass greater than said untethered support body, and said untethered support has a certain mass less than said free standing scoring body whereby said untethered support is more easily removed from stacked relation between said free standing scoring body and said untethered support body upon lateral impact thereto.

4. A game as described in claim 1 wherein a horizontal impact means is provided for striking said untethered support for removing said untethered support from between said basket and said free standing scoring body whereby when said untethered support is removed said free standing scoring body can drop toward said basket and by chance pass downwardly through said basket top aperture into said basket as a score of said game.

5. A game as described in claim 4 wherein horizontal impact means is a projectile directed horizontally against said untethered support by a game player.

6. A game as described in claim 5 wherein said projectile is a disc flown directly at said untethered support by a game player to provide dynamic impact to said untethered support to remove said untethered support from beneath said scoring body.

* * * * *